US012687321B2

(12) United States Patent
Beyhaghi et al.

(10) Patent No.: US 12,687,321 B2
(45) Date of Patent: Jul. 21, 2026

(54) LEAK DETECTION AND AUTOMATED SHUTOFF SYSTEMS USING WATER-SOLUBLE MATERIALS

(71) Applicant: Rheem Manufacturing Company, Atlanta, GA (US)

(72) Inventors: Saman Beyhaghi, Opelika, AL (US); Derek Ryan Bindbeutel, Atlanta, GA (US); Atilhan Manay, Roswell, GA (US); Christopher Mark Hayden, Shelton, CT (US); Harsha Satyanarayana, Norwalk, CT (US); Carl Francis Demolder, Encinitas, CA (US); Axel Hornickel, Hauts-de-seine (FR)

(73) Assignee: Rheem Manufacturing Company, Atlanta, GA (US)

( * ) Notice: Subject to any disclaimer, the term of this patent is extended or adjusted under 35 U.S.C. 154(b) by 425 days.

(21) Appl. No.: 18/458,922

(22) Filed: Aug. 30, 2023

(65) Prior Publication Data

US 2024/0068711 A1 Feb. 29, 2024

Related U.S. Application Data

(60) Provisional application No. 63/402,795, filed on Aug. 31, 2022.

(51) Int. Cl.

| | |
|---|---|
| ***F24H 15/31*** | (2022.01) |
| ***F24H 9/20*** | (2022.01) |
| ***F24H 15/12*** | (2022.01) |

(52) U.S. Cl.
CPC ..... *F24H 15/31* (2022.01); *F24H 9/2007* (2013.01); *F24H 15/12* (2022.01)

(58) Field of Classification Search
CPC ..... F24H 15/31; F24H 15/12; F24H 9/2007; F24H 15/305; F16K 31/003; F16K 31/56
See application file for complete search history.

(56) References Cited

U.S. PATENT DOCUMENTS 2,724,401 A * 11/1955 Page ..... F24H 9/2035 122/504
5,632,302 A * 5/1997 Lenoir, Jr. ..... F16K 31/02 307/118

(Continued)

*Primary Examiner* — Michael G Hoang
*Assistant Examiner* — Brett P. Mallon
(74) *Attorney, Agent, or Firm* — Eversheds Sutherland (US) LLP

(57) ABSTRACT

The present disclosure is directed to a mechanical and powerless leak detection and shutoff system that may be used in any commercially available water heater, e.g., both gas and electric. The system includes a spring-loaded shutoff assembly having a valve member operatively coupled to a fluid inlet line of the water heater. A handle of the shutoff assembly is maintained in an open configuration via a latching mechanism until a force is applied to cause the latching mechanism to release the handle and actuate the valve member to shutoff fluid flow through the fluid inlet line. The shutoff assembly is operatively coupled to a leak detection assembly via a cable. The leak detection assembly uses a fluid-soluble material that dissolves when exposed to fluid to thereby pull the cable to apply the force to disengage the latching mechanism.

17 Claims, 16 Drawing Sheets

(56) References Cited

U.S. PATENT DOCUMENTS

| | | | | |
|---|---|---|---|---|
| 6,792,967 | B1 * | 9/2004 | Franklin | F16K 31/001 122/504 |
| 7,424,896 | B1 * | 9/2008 | Martin | F16K 31/001 122/504 |
| 8,464,744 | B1 * | 6/2013 | Franklin | F16K 17/40 137/559 |
| 2020/0408328 | A1 * | 12/2020 | Schwarzbek | F16K 31/46 |

* cited by examiner

LEAK DETECTION AND AUTOMATED SHUTOFF SYSTEMS USING WATER-SOLUBLE MATERIALS

CROSS-REFERENCE TO RELATED APPLICATION

This application claims the benefit of U.S. application Ser. No. 63/402,795, filed Aug. 31, 2022, the entirety of which is hereby incorporated by reference.

TECHNICAL FIELD

The present disclosure is generally in the field of automated water heater shutoff systems and more particularly shutoff systems with a mechanical leak detection system using fluid-soluble materials.

BACKGROUND

According to insurance data, homeowners filed water damage as the second most frequent claim in the United States over the past 5 years. Water damage is ten times more likely than fire damage and is mostly preventable if proper notification and preventive action is taken in a timely manner. A major water leak causes a large disruption in people's lives. Most of the current solutions that detect a leak and prevent further water damage require electricity, such as electrical control mechanisms with an electrical actuation and detection system. It is desirable to have a simple and low cost leak detection and automatic shutoff system that can be implemented in commercially available water heaters without a significant additional cost. In addition, to make it applicable to lower end and gas water heaters, it is further desirable to develop a mechanical system that does not require external auxiliary power.

The foregoing background information is provided to reveal information believed by the applicant to be of possible relevance to the present disclosure. No admission is necessarily intended, nor should be construed, that any of the preceding information constitutes prior art against the present disclosure.

DETAILED DESCRIPTION

Figure 1:
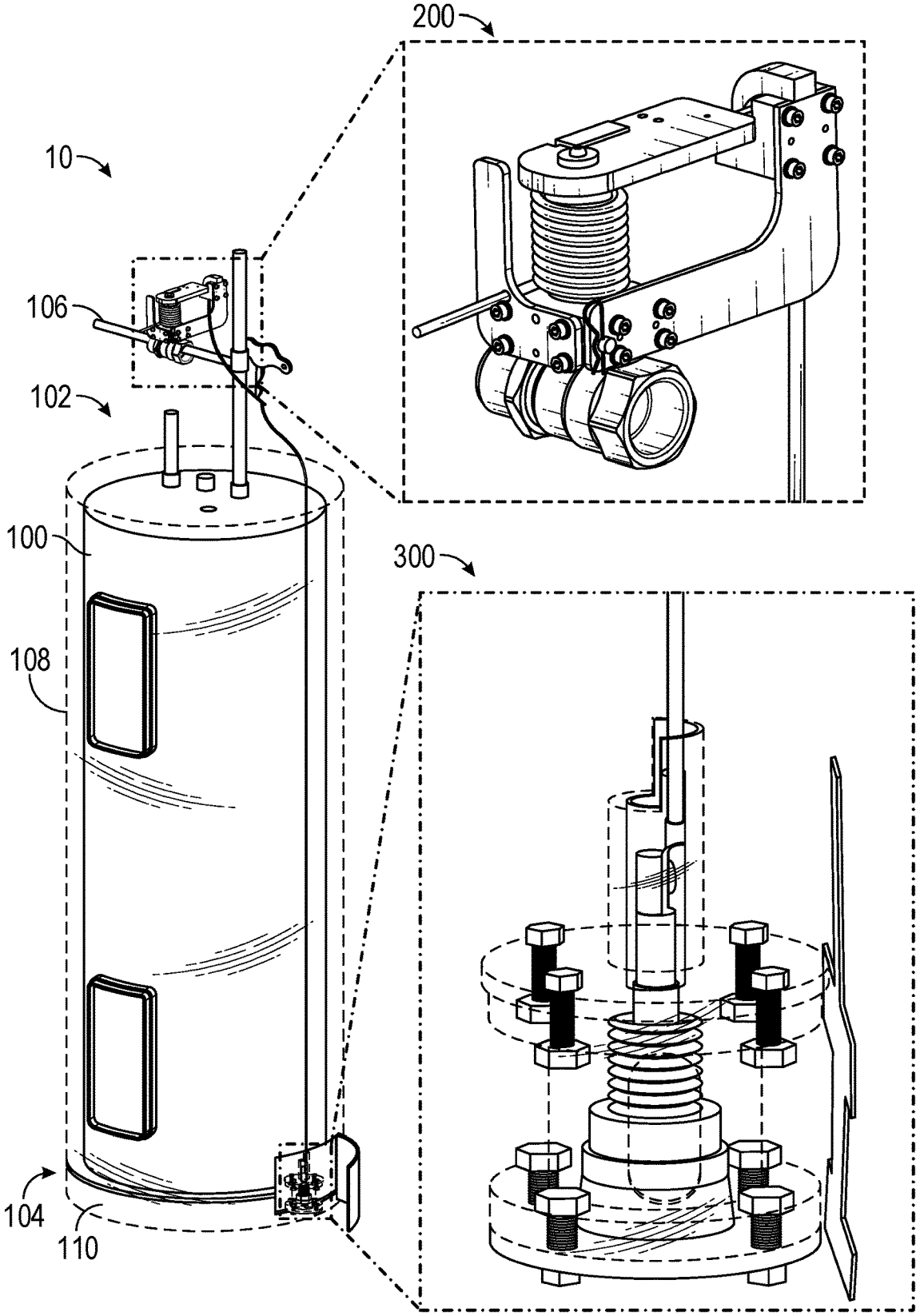
FIG. 1 illustrates a leak detection and automated mechanical shutoff system for a water heater constructed in accordance with the principles of the present disclosure.

The present disclosure is directed to a low cost and powerless leak detection and shutoff system that may be used in commercially available water heaters, e.g., both gas and electric. The systems disclosed herein may use materials with both good compression strength and fast dissolution rate, e.g., water soluble effervescent tablets, threads, and other water-soluble materials, as a means to detect the leak. The objective is to have a mechanism that does not require an external power source and therefore, can be used with gas water heaters disposed in locations where an electrical connection is not readily available. Moreover, the systems described herein may be used to shut off the gas supply or the heating element power, e.g., to break the circuit or to close the switch on a gas valve. In addition, the systems described herein are easily resettable.

Existing solutions typically rely on sensors for water detection and electricity for transmitting the leak signals to a control board and then to an electrically operated shut off valve. Those solutions come with high cost (on the order of few hundred dollars per unit) and may not be cost effective or even feasible to apply on all water heaters. A major advantage of the proposed systems described herein is that they are a universal solution with a mechanical system. In addition, the fluid-soluble material, e.g., water-soluble tablets, has shown to be very resistant against the ambient humidity, has a great compression strength, and can dissolve very fast when partially or fully submerged in water. For example, the water-soluble tablets may withstand at least 40 lbs of force when in contact with, e.g., a compression spring, and may dissolve in under a minute, e.g., within 15 to 30 seconds.

Further, the system includes a mechanically advantageous quick release mechanism, which greatly reduces the amount of force needed upon leak detection to trigger the shut off mechanism. Moreover, the system may be easily reset by removing the back lid of the leak detection system and replacing the fluid-soluble tablets, and rotating the shut off valve handle to its initial position and securing it with the latch, as described in further detail below. The fluid-soluble material may be provided in any manner that allows easy replacement after a leak has been detected and a shut off has occurred, e.g., a stack of multiple disks/tablets, or one large solid block, with or without a water-permeable wrap.

Additionally, the systems do not require access to an external power source and thus, may be easily installed without modifications of the electrical infrastructure. Accordingly, user experience is improved by adding an extra layer of protection of the installation site from water damage. Moreover, the triggers of the system may be modified to fit the need of different installations.

Some representative embodiments will be described more fully hereinafter with example reference to the accompanying drawings that illustrate embodiments of the invention. Embodiments may take many different forms and should not be construed as limited to the embodiments set forth herein; rather, these embodiments are provided so that this disclosure will be thorough and complete, and will fully convey the scope of the invention to those appropriately skilled in the art.

In accordance with one aspect of the present disclosure, a mechanical shutoff system for use with a water heater having a fluid inlet line is provided. The system may include a spring-loaded shutoff assembly operatively coupled to the fluid inlet line and a leak detection assembly configured to be positioned in fluid communication with fluid leaking from the water heater. For example, the spring-loaded shutoff assembly may include a handle configured to transition between an open configuration where fluid flow is permitted through the fluid inlet line and a closed configuration where fluid flow is not permitted through the fluid inlet line, and a torsion spring operatively coupled to the handle and configured to bias the handle toward the closed configuration. The shutoff assembly further may include a latch configured to transition between a locked configuration where the latch maintains the handle in the open configuration and an unlocked configuration where the torsion spring causes the handle to transition to the closed configuration.

Moreover, the leak detection assembly may include a chamber sized and shaped to receive a fluid-soluble material, e.g., one or more water-soluble effervescent tablets, a lower lid having an opening for receiving fluid into the chamber, and a piston operatively coupled to the latch of the spring-loaded shutoff assembly via a cable extending therebetween. The piston may transition between a first position and a second position where the cable causes the latch to transition from the locked configuration to the unlocked configuration. The leak detection assembly further may include a compression spring operatively coupled to the piston and configured to bias the piston toward the second position. Accordingly, the fluid-soluble material are positionable between the piston in the first position and the lower lid, such that as fluid enters the chamber via the opening, the fluid-soluble material dissolves and the compression spring causes the piston to transition from the first position to the second position to thereby cause the handle of the spring-loaded shutoff assembly to transition from the open configuration to the closed configuration to shut off fluid flow through the fluid inlet line.

The spring-loaded shutoff assembly may include a valve assembly pivotally coupled to the handle, the valve assembly configured to be attached to a valve, e.g., a ball valve, in fluid communication with the fluid inlet line. Further, the valve assembly may include a rotatable drive shaft having first end fixedly coupled to the handle and a second end operatively coupled to the valve, such that as the handle transitions from the open configuration to the closed configuration, the second end of the drive shaft actuates the valve to shut off fluid flow through the fluid inlet line. The spring-loaded shutoff assembly may include a frame assembly coupled to the valve assembly, such that the frame assembly is configured to support the torsion spring and the latch. For example, a first end of the torsion spring may be fixedly coupled to the frame assembly, and a second end of the torsion spring is fixedly coupled to the handle. Accordingly, when the handle is in the closed configuration, the torsion spring has a spring force sufficient to actuate the valve to shut off fluid flow through the fluid inlet line.

In addition, the handle may include an impact zone configured to contact the frame assembly when the handle is in the closed configuration, such that the impact zone is configured to dampen a force applied to the handle by the frame assembly. Moreover, the frame assembly may include a first frame arm coupled to a first face of the valve assembly and fixedly coupled to a first end of the torsion spring, and a second frame arm coupled to a second face of the valve assembly and operatively coupled to the latch. At least one of the first or second frame arms may have an L-shape. The latch may include a base portion fixedly coupled to the frame assembly, and a latching arm pivotally coupled to the base portion, such that the latching arm is configured to pivotally transition between the locked configuration where the latch maintains the handle in the open configuration and the unlocked configuration.

Moreover, the latch may include a retractable pin configured to transition between a locked state where the retractable pin maintains the latching arm in the locked configuration and an unlocked state wherein the retractable pin disengages with the latching arm to permit the latching arm to transition from the locked configuration to the unlocked configuration. The cable may be operatively coupled to the latch via the retractable pin. When the piston is in the first position, the compression spring may have a spring force sufficient to transition the retractable pin from the locked state to the unlocked state. The retractable pin may be biased toward the locked state. The handle may include an extension rod configured to extend from the handle toward the latch, such that, in the locked configuration, the latch secures the extension rod therein to maintain the handle in the open configuration.

Regarding the leak detection assembly, the piston may include a piston rod having a first end operatively coupled to the cable, and a second end. In addition, the piston may include a piston head coupled to the second end of the piston rod, such that the piston head is configured to contact the fluid-soluble material. Accordingly, the compression spring may be disposed between an upper surface of the chamber and the piston head. In addition, the lower lid may be configured to be disposed a predefined distance from a ground, such that fluid leaking from the water heater must accumulate over at least the predefined distance to reach the opening of the lower lid. The leak detection assembly may include one or more vents configured to permit byproducts of dissolution of the fluid-soluble material to escape therethrough.

In accordance with another aspect of the present disclosure, a mechanical shutoff system for use with a water heater having a fluid inlet line is provided. The system may include a valve assembly configured to be attached to a valve in fluid communication with the fluid inlet line, a handle pivotally coupled to the valve assembly and configured to transition between an open configuration where the valve permits fluid flow through the fluid inlet line and a closed configuration where valve does not permit fluid flow through the fluid inlet line, a torsion spring operatively coupled to the handle and configured to bias the handle toward the closed configuration, a latch configured to transition between a locked configuration where the latch maintains the handle in the open configuration and an unlocked configuration where the torsion spring causes the handle to transition to the closed configuration, and a cable having a first end operatively coupled to the latch and a second end operatively coupled to a leak detection assembly. The leak detection assembly may be configured to pull the cable upon detection of a leak of the water heater to cause the latch to transition from the locked configuration to the unlocked configuration to thereby cause the handle of the spring-loaded shutoff assembly to transition from the open configuration to the closed configuration to shut off fluid flow through the fluid inlet line.

In accordance with yet another aspect of the present disclosure, a leak detection assembly configured to be positioned in fluid communication with fluid leaking from the water heater is provided. The leak detection assembly may include a frame defining a chamber configured to receive a fluid-soluble material, a lower lid of the frame having an opening for receiving fluid into the chamber, a piston including a piston rod coupled to a piston head, the piston configured to transition between a first position and a second position, and a compression spring positioned between an upper surface of the frame and the piston head. The compression spring is configured to bias the piston toward the second position. Accordingly, the fluid-soluble material is positionable between the piston head in the first position and the lower lid, such that as fluid enters the chamber via the opening, the fluid-soluble material dissolves and the compression spring causes the piston to transition from the first position to the second position.

Referring now to FIG. 1, a leak detection and automated mechanical shutoff system is provided. System 10 includes shutoff assembly 200 and leak detection assembly 300, which may be used with an appliance that may experience a fluid leak, e.g., water heater 100. Leak detection assembly 300 may detect a fluid leak of water heater 100, e.g., by interacting with fluid leaking from water heater 100, such that upon detection of the fluid leak, leak detection assembly 300 mechanically actuates shutoff assembly 200 to automatically shutoff fluid flow into water heater 100.

As shown in FIG. 1, water heater 100 may include upper portion 102 and lower portion 104. Water heater 100 includes fluid inlet line 106, which may be coupled to water heater 100 at upper portion 102 to supply fluid to water heater 100. Alternatively, the fluid inlet line of a water heater or other appliance may be coupled to another portion of the water heater or appliance, and further may extend along additional portions of the water heater or appliance, such as along the side and/or around the lower portions of the water heater or appliance. Accordingly, shutoff assembly 200 may be fluidicly coupled to fluid inlet line 106, such that shutoff assembly 200 may be actuated, e.g., via leak detection assembly 300, to permit or not permit fluid flow through fluid inlet line 106 and into water heater 100. As described in further detail below, shutoff assembly 200 may be coupled to the fluid inlet line of commercially available water heaters at the time of installation and/or may be retrofitted to be coupled to the fluid inlet line of any commercially available water heater subsequently post-installation.

As shown in FIG. 1, water heater 100 also may include tank jacket 108 defining a space between the body of water heater 100 and jacket 108, and/or drain tray 110, which extends circumferentially around lower portion 104 of water heater 100 to collect fluid leaking from water heater 100. For example, fluid leaking from water heater 100 may flow down the external sides of water heater 100 and collect within drain tray 110. Accordingly, leak detection assembly 300 may be positioned within drain tray 110, e.g., within jacket 108 via an access door integrated with jacket 108, such that fluid leaking from water heater 100 may interact with leak detection assembly 300, as described in further detail below. Alternatively, the drain tray may be separate from the water heater assembly, e.g., a separate drain pan in fluid communication with the leak of water heater 100. The separate drain pan may be wider than drain tray 110, e.g., by a few inches.

Referring now to FIGS. 2A to 2G, a spring-loaded shutoff system is provided. Shutoff system 200 may include valve attachment assembly 202, which may be coupled to valve member 220. Valve member 220 is configured to be fluidicly coupled to fluid inlet line 106. For example, one end of valve member 220 may have a female mating portion, e.g., female threaded surface, and the other end of valve member 220 may have a male mating portion, e.g., male threaded surface, such that valve member 220 may be coupled to fluid inlet line 106 via a threaded connection. Alternatively, depending on the water heater's fluid inlet line, valve member 220 may be adapted to be fluidicly coupled to the fluid inlet line via other connection mechanism, e.g., snap fit, friction fit, etc.

Figure 2A:
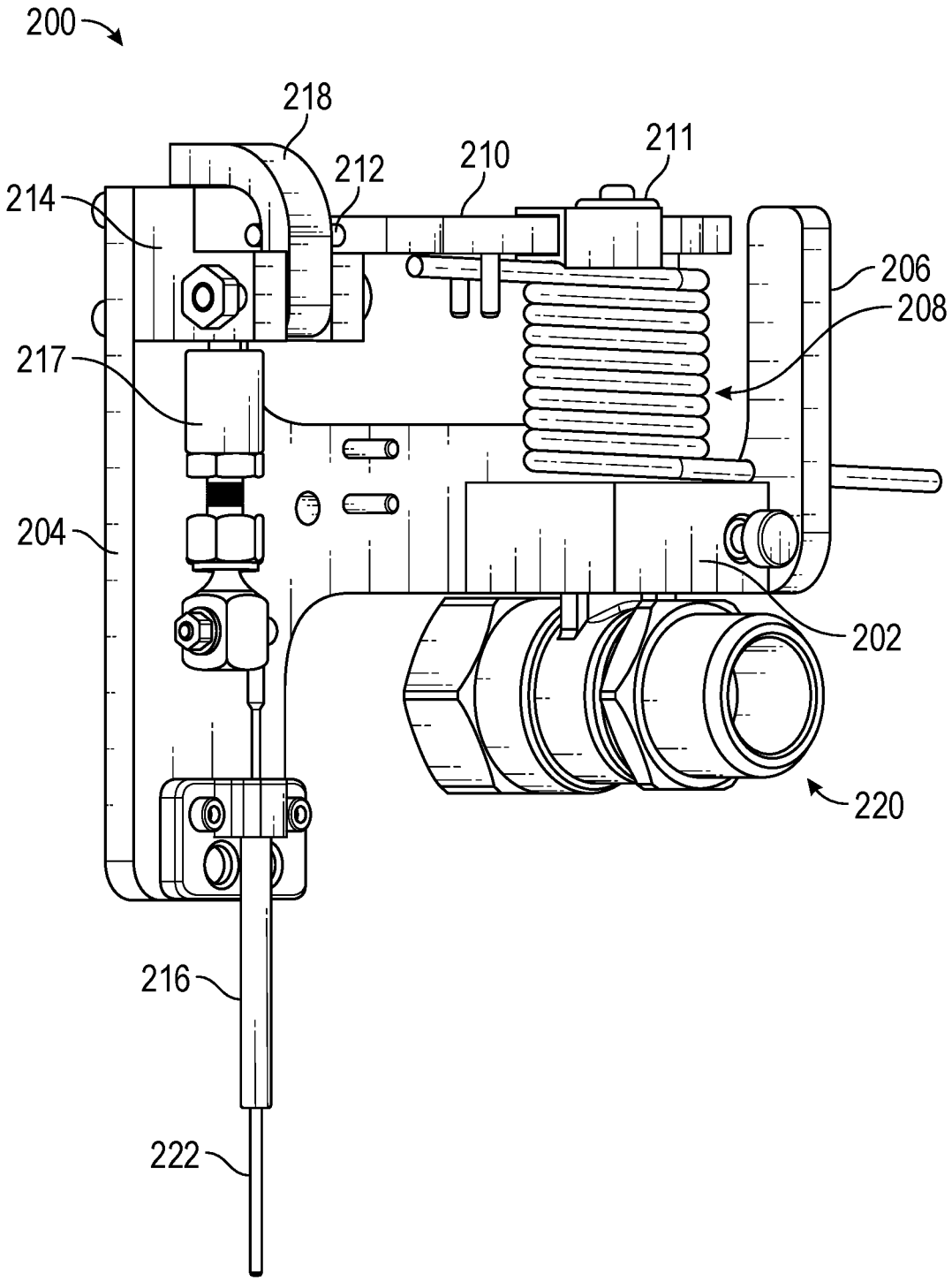
FIG. 2A is a perspective view of an automated mechanical shutoff assembly constructed in accordance with the principles of the present disclosure.
Figure 2B:
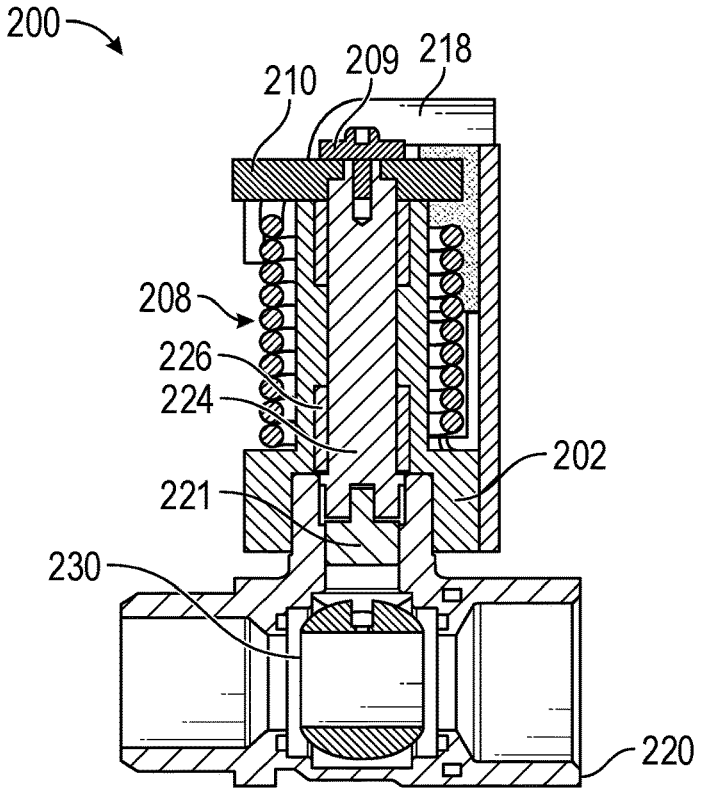
FIG. 2B is a cross-sectional view of the automated mechanical shutoff assembly of FIG. 2A.

As shown in FIG. 2B, valve member 220 may include valve 230, e.g., a ball valve, disposed within the lumen of valve member 220. Valve 230 may be actuated via drive shaft 224 to open and close valve 230, to thereby permit or prevent fluid flow across valve 230. For example, one end of drive shaft 224 may engage with valve actuator 221 operatively coupled to valve 230, such that rotation of drive shaft 224 causes valve actuator 221 to rotate between a first position where valve 230 is in a closed configuration and fluid is not permitted to flow therethrough and a second position where valve 230 is in an opening configuration where fluid is permitted to flow therethrough. As shown in FIG. 2B, drive shaft 224 may extend within valve attachment assembly 202 between valve actuator 221 and handle 210, such that the other end of drive shaft 224 may be fixedly coupled to handle 210, e.g., via screw 209. Accordingly, rotation of handle 210 relative to valve attachment assembly 202 causes rotation of drive shaft 224 to thereby actuate valve 230 via valve actuator 221.

Referring again to FIG. 2A, shutoff assembly 200 further may include a frame assembly coupled to valve attachment assembly 202. For example, the frame assembly may include first frame 204 coupled to a first face/side of valve attachment assembly 202, and second frame 206 coupled to a second face/side of valve attachment assembly 206. As shown in FIG. 2A, valve attachment assembly 202 may have a four-sided profile, e.g., a square or rectangle, such that first frame 204 and second frame 206 may be coupled to adjacent sides of valve attachment assembly 202. Accordingly, first frame 204 may extend in a plane perpendicular to the plane in which second frame 206 extends. As shown in FIG. 2A, first frame 204 may have a T-shaped profile, and second frame 206 may have an L-shaped profile. Alternatively, first frame 204 may have an L-shaped profile, and second frame 206 may have a T-shaped profile, or first frame 204 and second frame 206 may have the same shape, e.g., both having L-shaped profiles. For example, FIGS. 2B to 2G illustrate shutoff assembly 200 with both first frame 204 and second frame 206 having an L-shaped profile.

Moreover, handle 210 may include a quick-release mechanism, such that handle 210 is configured to transition between a first open configuration where handle 210 is secured via latching arm 218, and a second closed configuration where handle 210 has rotated drive shaft 224 to thereby actuate valve 230 to prevent fluid flow through valve member 220. Handle 210 may be biased toward the closed configuration, e.g., via torsion spring 208. For example, torsion spring 208 may have a first end fixedly coupled to second frame 208 and a second end fixedly coupled to handle 210. In addition, torsion spring 208 may be pre-wound such that when handle 210 is in the open configuration, torsion spring 208 has a spring force sufficient to rotate drive shaft 224 and valve actuator 221 to thereby actuate valve 230.

As shown in FIG. 2A, shutoff assembly 200 further may include a latching mechanism, e.g., base portion 214 and latching arm 218 pivotally coupled to base portion 214 via pivot pin 219, coupled to first frame 204. Accordingly, latching arm 218 may pivotally transition between a locked configuration where latching arm 218 maintains handle 210 in its open configuration, and an unlocked configuration where latching arm 218 releases handle 210 to permit handle 210 to transition to its closed configuration. In addition, handle 210 may include rod 212 extending from handle 210 toward the latching mechanism, such that rod 212 is secured between latching arm 218 and base portion 214 when latching arm 218 is in its locked configuration to maintain handle 210 in its open configuration.

As shown in FIG. 2A, retractable pin 217 may be disposed below base portion 214, such that a portion of retractable pin 217 extends through base portion 214 and through at least a portion of latching arm 218. Accordingly, latching arm 218 may have groove 215 (shown in FIG. 2F) sized and shaped to receive the portion of retractable pin 217 therein. Retractable pin 217 is configured to transition between a locked state where retractable pin 217 is disposed within the groove of latching arm 218, and an unlocked state where retractable pin 217 disengages with latching arm 218. For example, retractable pin 217 may be biased toward its locked state, such that actuation of retractable pin 217, for example, via a downward pulling force by a displacement transfer cable, e.g., cable 222, operatively coupled to retractable pin 217, causes retractable pin 217 to transition from its locked state to its unlocked state.

Figure 2C:
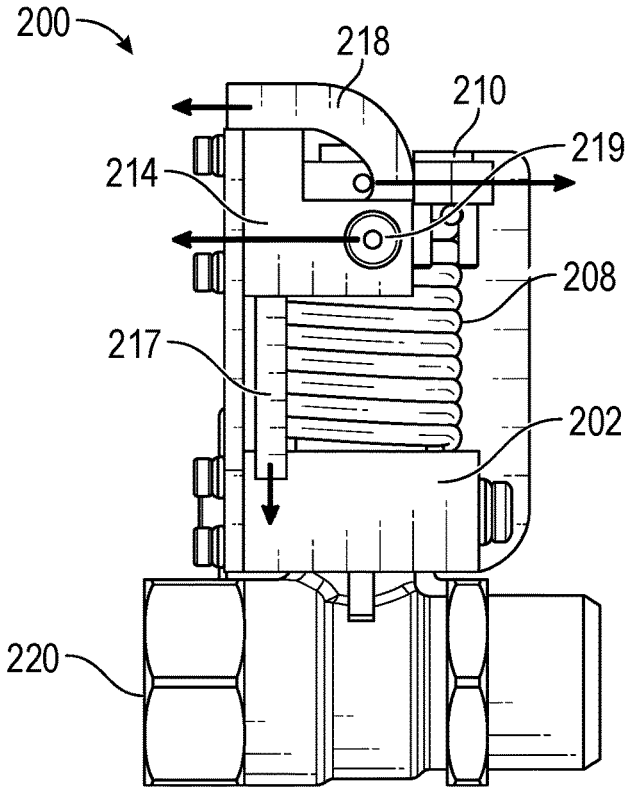
FIG. 2C illustrates the forces required to transition the automated mechanical shutoff assembly from an open configuration to a closed configuration.

FIG. 2C illustrates the forces acting on shutoff assembly 200 required for retractable pin 217 to disengage with latching arm 218 to permit latching arm 218 to release handle 210. For example, when latching arm 218 is in its locked configuration, e.g., via engagement with retractable pin 217, to maintain handle 210 in its open configuration, handle 210 applies a first force, e.g., equivalent to the spring force of torsion spring 208, on the latching mechanism as denoted by the rightward facing arrow, and accordingly, the latching mechanism applies a second force, e.g., via latching arm 218 and pivot point 219 of the latching mechanism, denoted by the two leftward facing arrows, which is collectively equal and opposite to the first force applied by handle 210. Accordingly, shutoff assembly 200 is in static equilibrium. For example, if the first force applied by handle 210 is ten pounds, latching arm 218 may apply a five pound force and pivot point 219 may apply a five pound force, such that together latching arm 218 and pivot point 219 applies the same amount of force to handle 210 in the opposite direction to maintain handle 210 in its open configuration. Moreover, retractable pin 217 may only require a substantially less amount of force to disengage with latching arm 218, as denoted by the downward facing arrow. For example, retractable pin 217 may only require one pound of force to transition from its locked state to its unlocked state to disengage with latching arm 218.

Figure 2D:
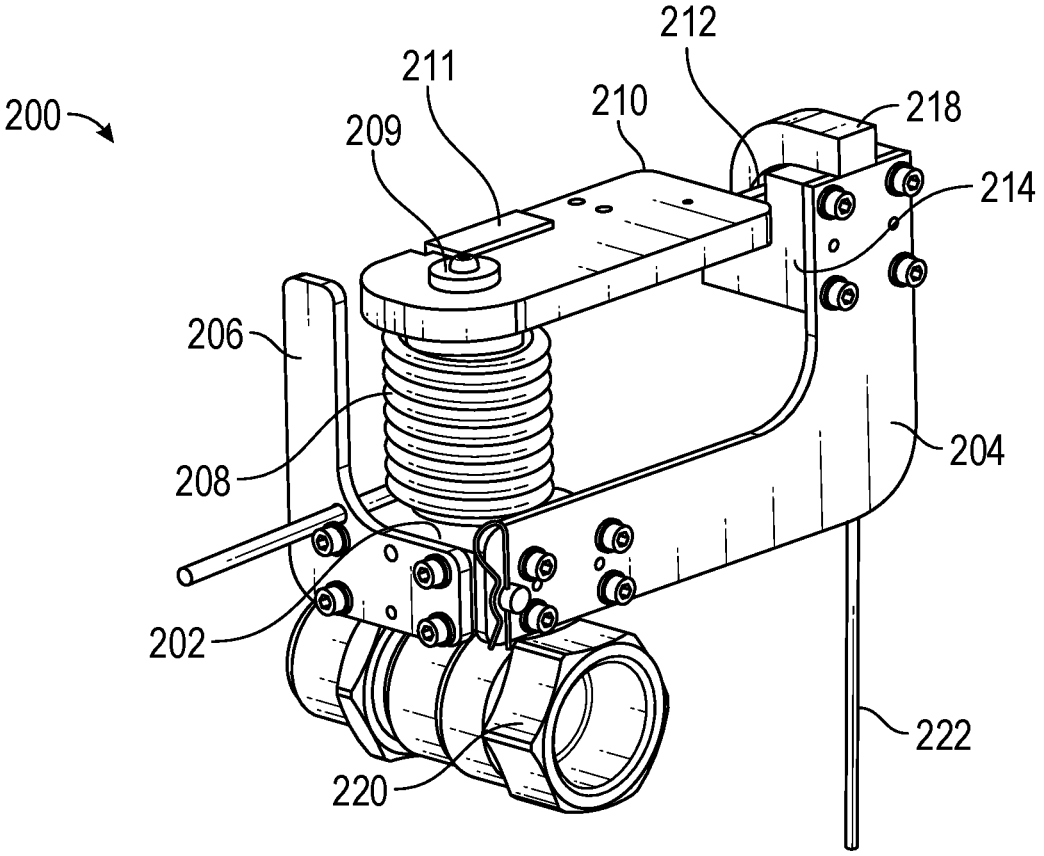
FIGS. 2D and 2E are various views of the automated mechanical shutoff assembly in an open configuration.
Figure 2E:
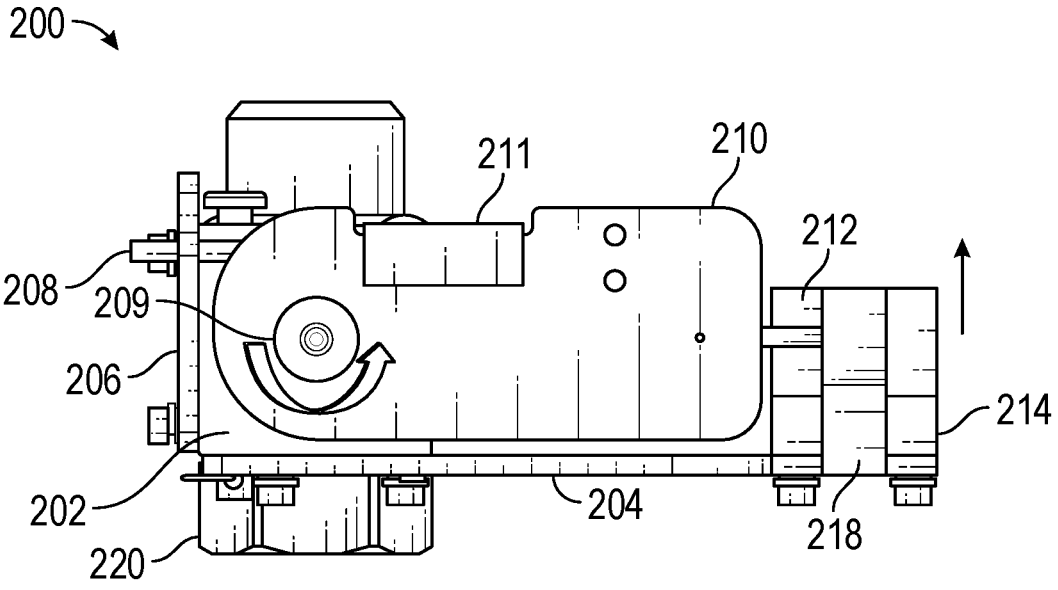
Figure 2F:
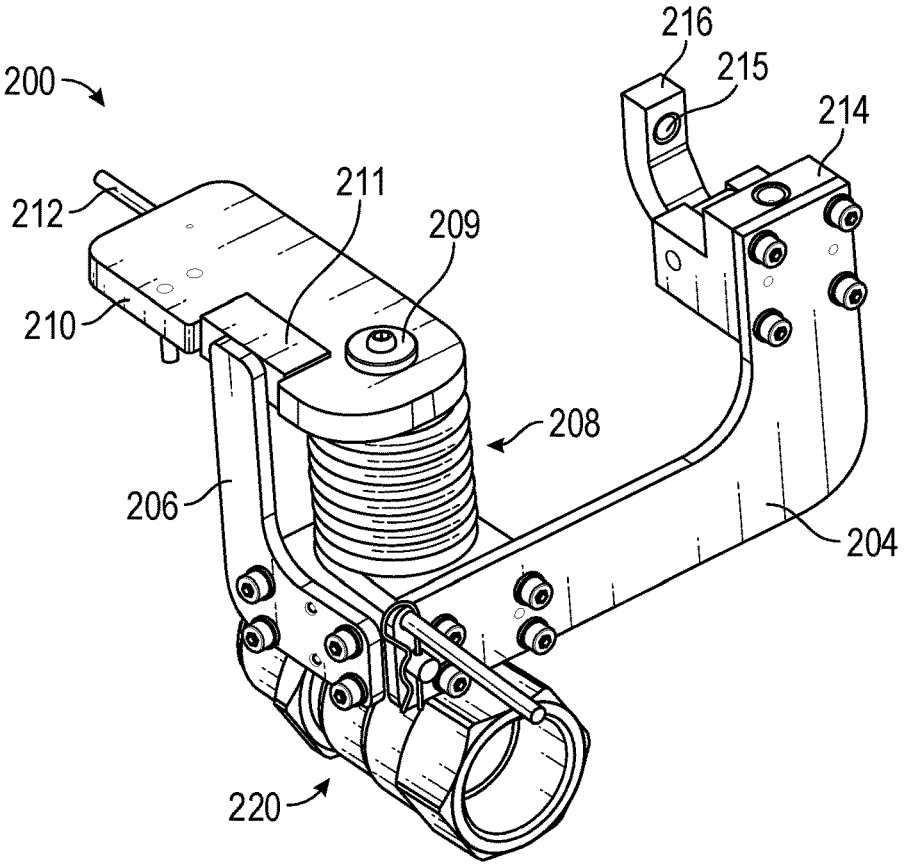
FIGS. 2F and 2G are various views of the automated mechanical shutoff assembly in a closed configuration.
Figure 2G:
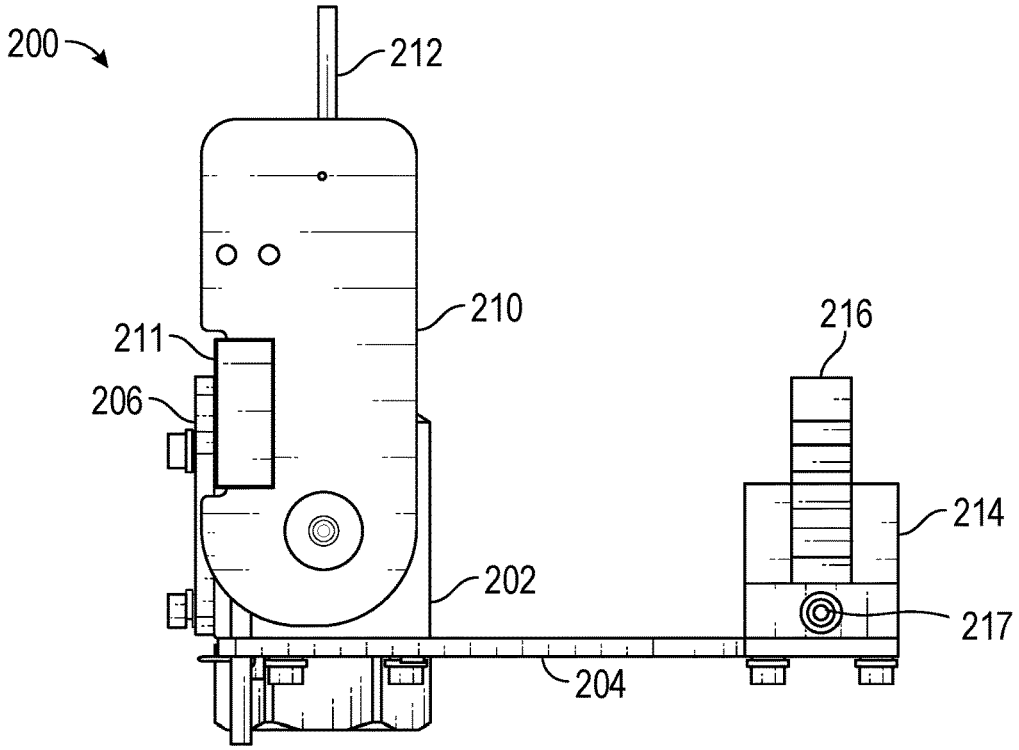

When retractable pin 217 is disposed within the groove of latching arm 218, latching arm is maintained in its locked configuration, as shown in FIGS. 2D and 2E, and when retractable pin 217 disengages with latching arm 218, the spring force of torsion spring 208 causes rod 212 of handle 210 to transition latching arm 218 from its locked configuration to its unlocked configuration, as shown in FIGS. 2F and 2G, as there is no longer any force maintaining latching arm 218 in its locked configuration. Handle 210 may include impact zone 211, which is configured to dampen force applied to handle 210 by second frame 206. For example, as shown in FIGS. 2F and 2G, when handle 210 is in its closed configuration, impact zone 211 of handle 210 may be in contact with second frame 206. Notably, the spring force of torsion spring 208 is high enough such that upon release from latching arm 218, the spring force is sufficient to rotate handle 210, e.g., by 90 degrees, to thereby rotate drive shaft 224 to actuate valve 230. Accordingly, the spring force of torsion spring 208 will likely cause handle 210 to collide with second frame 206, and impact zone 211 will dampen the force that second frame 206 applies to handle 210 upon the collision.

Referring again to FIG. 2A, retractable pin 217 may be operatively coupled to cable 222, e.g., a Bowden cable, via connection member 216, such that a downward pulling force by cable 222 pulls connection member 216 downward, which causes retractable pin 217 to be pulled from its locked state to its unlocked state. As described in further detail below with reference to FIG. 3A, leak detection assembly 300 may be configured to pull cable 222 upon detection of a fluid leak of water heater 100, to thereby pull retractable pin 217 to its unlocked state and permit latching arm 218 to release handle 210, such that handle 210 transitions from its open configuration to its closed configuration, thereby rotating drive shaft 224 to actuate valve 230 and prevent fluid flow through fluid inlet line 106 into water heater 100.

Figure 3A:
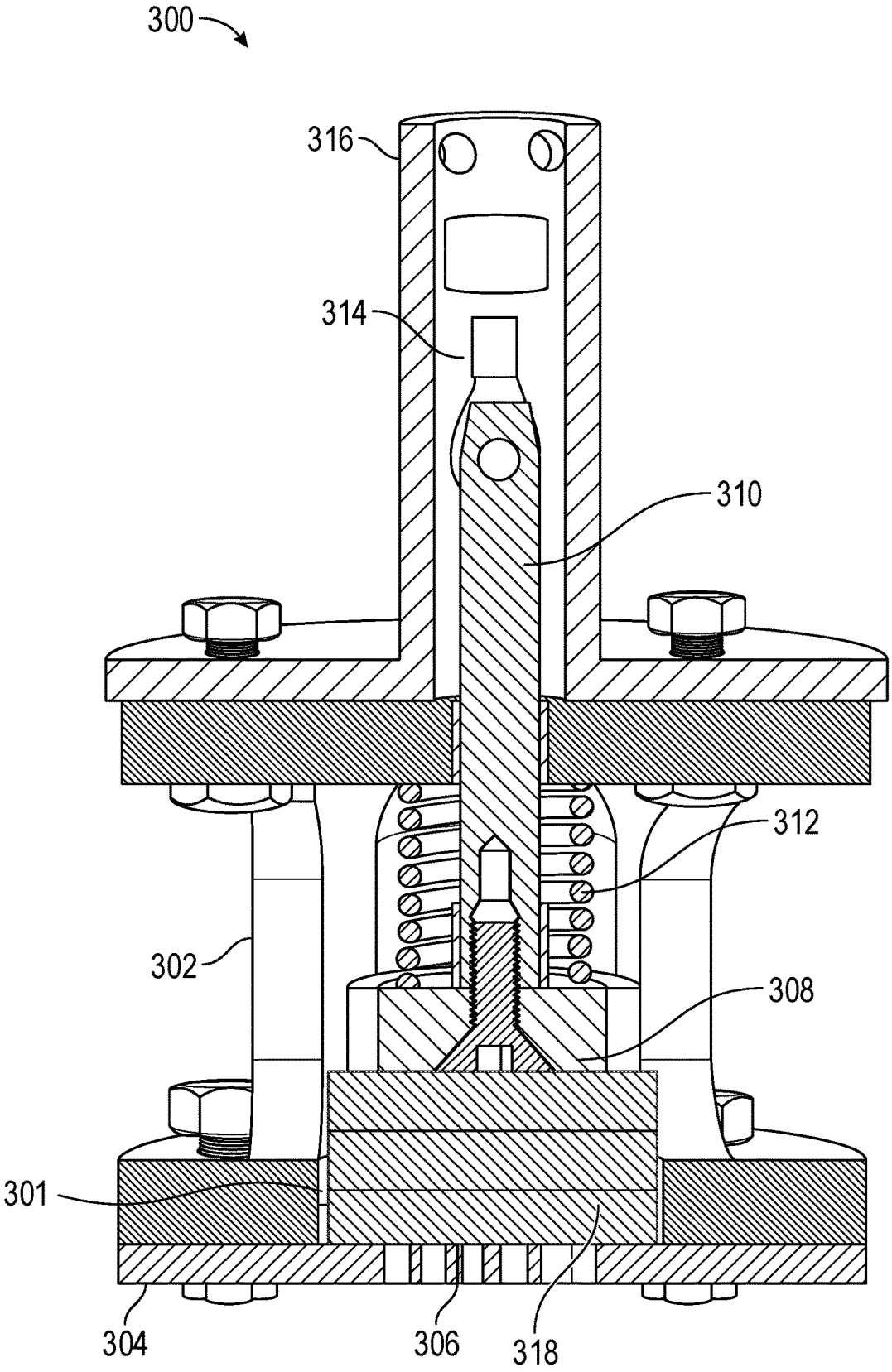
FIG. 3A is a cross-sectional view of a leak detection assembly constructed in accordance with the principles of the present disclosure.
Figure 3B:
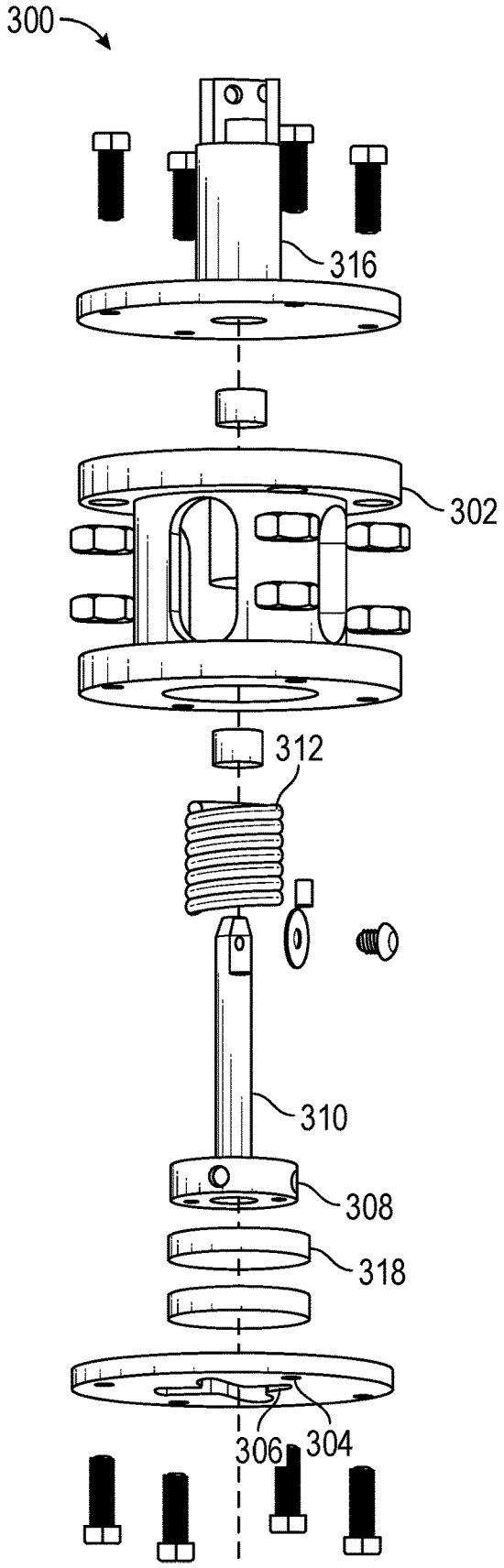
FIG. 3B is an exploded view of the leak detection assembly of FIG. 3A.
Figure 3C:
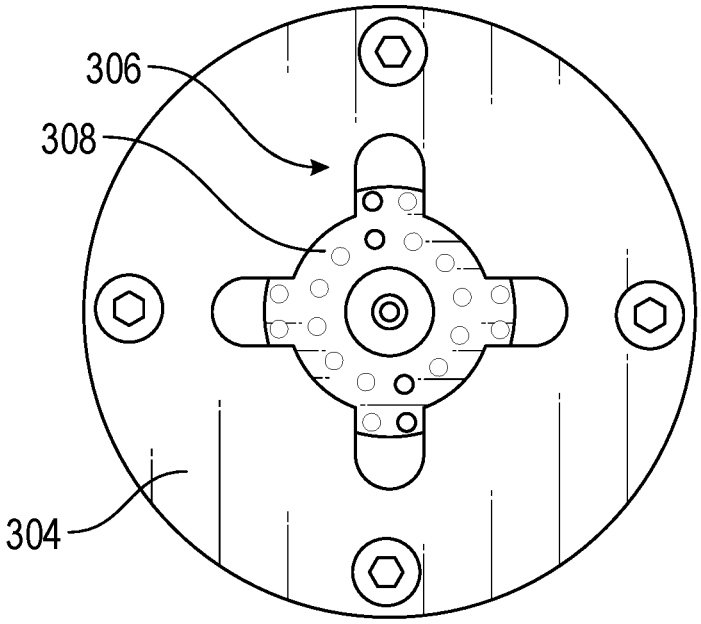
FIG. 3C is a bottom view of the leak detection assembly of FIG. 3A.

Referring now to FIGS. 3A to 3C, a leak detection assembly is provided. Leak detection assembly 300 includes a body, e.g., frame 302, and lower lid 304, which together define chamber 301 sized and shaped to receive a fluid-soluble material, e.g., one or more fluid-soluble tablets 318, therein. For example, fluid-soluble tablets 318 may be disk-shaped, water-soluble effervescent tablets, e.g., sodium bi-carbonate tablets optionally comprising a mixture of organic acids, that have a chemical composition such that they dissolve upon interaction with fluid. Moreover, fluid-soluble tablets 318 are resistant against the ambient humidity, have great compression strength, and can dissolve quickly when partially or fully submerged in fluid. For example, fluid-soluble tablets 318 may withstand at least 40 lbs of force when in contact with, e.g., compression spring 312, and may dissolve in under a minute, e.g., within 15 to 30 seconds. Frame 302 may include one or more vents configured to permit byproducts of fluid-soluble tablets 318, e.g., carbon dioxide, to escape therethrough as fluid-soluble tablets 318 dissolves. For example, the byproducts may escape chamber 301 via openings on the side of frame 302, through small holes made inside piston head 308, or downward through opening 306 of lower lid 304.

The chamber is further sized and shaped to receive fluid therein, e.g., fluid leaking from water heater 100. For example, lower lid 304 positioned at the bottom of frame 302 may include one or more openings 306 sized and shaped to permit fluid to flow therethrough from outside of leak detection assembly 300 into chamber 301, as shown in FIG. 3C. In addition, lower lid 304 may be positioned at a predefined distance from the ground, e.g., the bottom of drain tray 110 when leak detection assembly 300 is positioned within drain tray 110, such that fluid must accumulate within drain tray 110 until the height of the fluid reaches the predefined distance such that the fluid may pass through open 306 of lower lid 304. For example, lower lid 304 may be positioned a quarter of an inch from the ground.

As shown in FIGS. 3A and 3B, leak detection assembly 300 may include upper lid 316 positioned at the top of frame 302. Upper lid 316 may include a flat portion that is coupled to the top of frame 302, and an extended portion extending upwardly from the flat portion. The extended portion of upper lid 316 may have a tubular shape with a cavity extending therethrough. As shown in FIG. 3B, frame 302, lower lid 304, and the flat portion of upper lid 316 may have a circular profile, and the outer edges thereof may have substantially equal diameters.

Leak detection assembly 300 further may include a piston having piston rod 310 coupled to piston head 308, such that piston rod 310 extends through the cavity of the extended portion of upper lid 316 and piston head 308 is positioned within chamber 301. For example, piston head 308 may be coupled to piston rod 310 via a screw connection. Alternatively, piston head 308 and piston rod 310 may be formed as a unitary component. The end of piston rod 310 opposite to the end that is coupled to piston head 308 may be configured to be coupled to cable 222, e.g., via connection 314, such that the piston is operatively coupled to the latching mechanism of shutoff assembly 200 via retractable pin 217.

The piston is configured to move between a first position where piston head 308 is in contact with fluid-soluble tablets 318 prior to contact with fluid, and a second position when fluid interacts with fluid-soluble tablets 318, causing fluid-soluble tablets 318 to dissolve. For example, the piston may be biased toward the second position via compression spring 312 coupled to piston head 308 and disposed between piston head 308 and the upper surface of frame 302 within chamber 301. Accordingly, when fluid-soluble tablets 318 are positioned within chamber 301 between piston head 308 and lower lid 304, as shown in FIG. 3A, compression spring 312 is in a compressed state having a spring force sufficient to pull cable 222 to transition retractable pin 217 from the locked state to the unlocked state. As described above, fluid-soluble tablets 318 are selected such that they have sufficient compression strength (pre-fluid exposure) to withstand the force applied thereto by compression spring 312 via piston head 308.

As fluid enters chamber 301, e.g., via opening 306 of lower lid 304, the fluid dissolves fluid-soluble tablets 318, thereby permitting compression spring 312 to decompress such that the spring force of compression spring 312 pushes piston head 308 against fluid-soluble tablets 318 toward lower lid 304. As piston head 308 pushes against fluid-soluble tablets 318 and moves downward within chamber 301 relative to frame 302, piston rod 310 also moves downward, e.g., within the extended portion of upper lid 316, thereby applying a pulling force to cable 222. Fluid-soluble tablets 318 will continue to dissolve upon exposure to fluid within chamber 301, thereby permitting the piston to continually pull cable 222 until retractable pin 217 disengages with latching arm 218 and handle 210 is released.

Figure 4A:
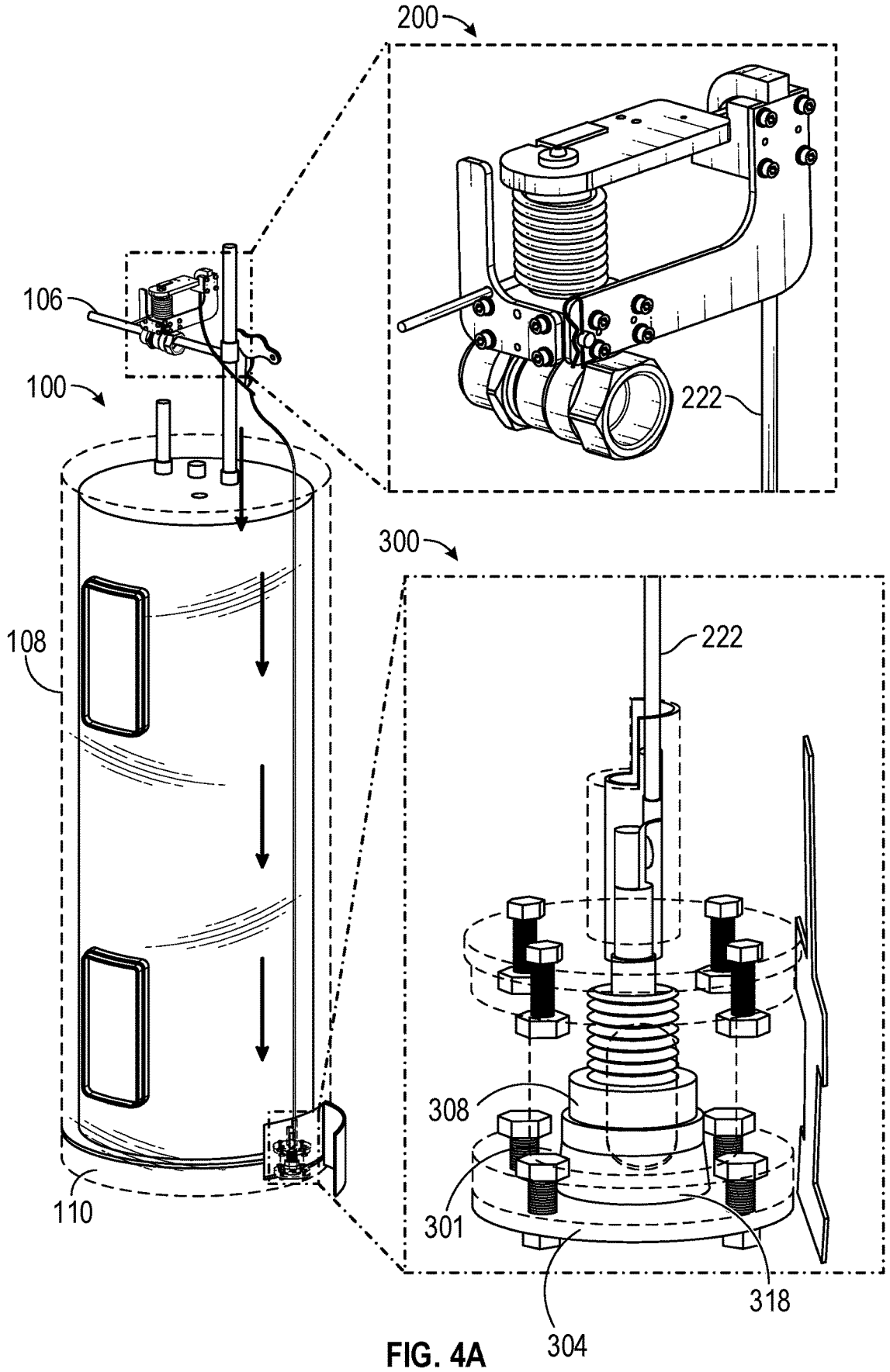
FIGS. 4A to 4D illustrate steps for detecting a leak and automatically shutting off a water heater using the system of FIG. 1.

Referring now to FIGS. 4A to 4D, steps for detecting a leak via leak detection assembly 300 and automatically shutting off water heater 100 via shutoff assembly 200 is provided. As shown in FIG. 4A, prior to leak detection, fluid is permitted to flow through fluid inlet line 106 and into water heater 100 via valve member 220. Shutoff assembly 200 is coupled to fluid inlet line 106 via valve member 220, and leak detection assembly 300 is positioned within drain tray 110 at the bottom of water heater 100. Moreover, shutoff assembly 200 is operatively coupled to leak detection assembly 300 via cable 222 extending from retractable pin 217 of shutoff assembly 200 to piston rod 310 of leak detection assembly 300.

Figure 4B:
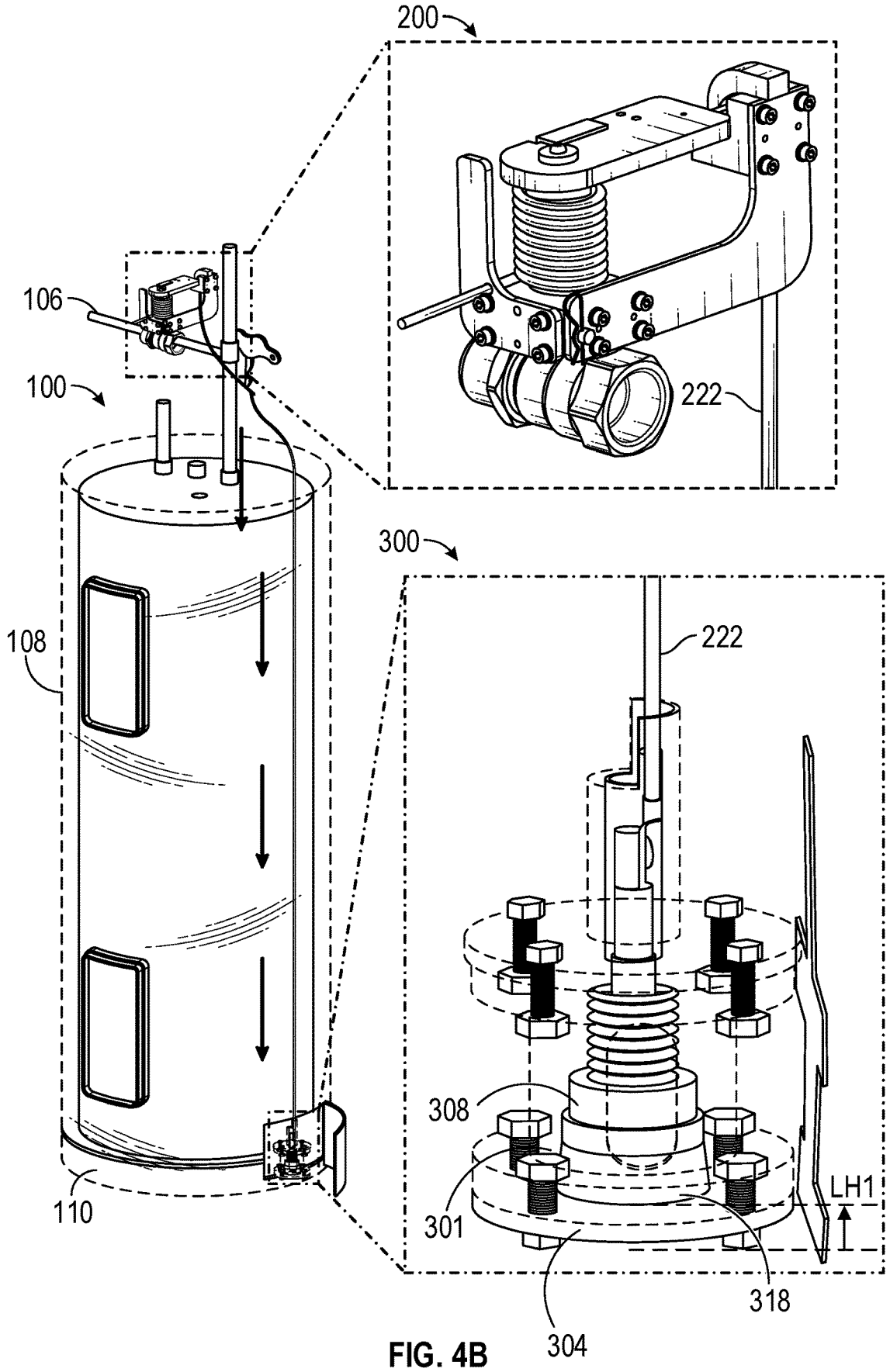

As shown in FIG. 4B, fluid leaking from water heater 100 begins to collect within drain tray 110 in contact with leak detection assembly 300, as indicated by leak height line LH1. As described above, lower lid 304 may be positioned a predefined distance from the bottom of drain tray 110, such that fluid must accumulate within drain tray 110 to a height high enough to reach opening 306 of lower lid 304.

Figure 4C:
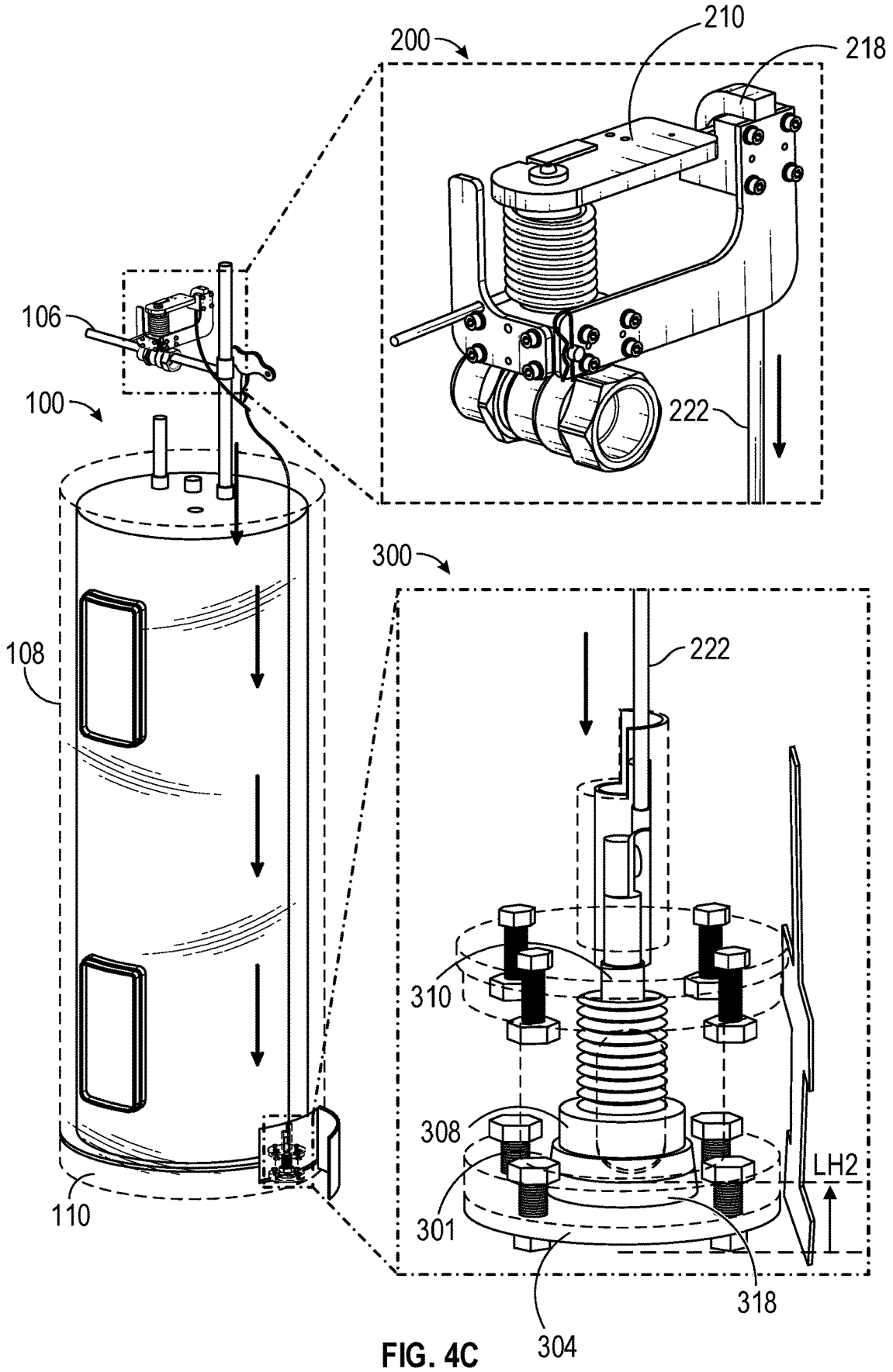

As shown in FIG. 4C, the fluid accumulating within drain tray 110 enters chamber 301 of leak detection assembly 300, e.g., via opening 306 of lower lid 304, as indicated by leak height line LH2, such that the fluid interacts with one or more fluid-soluble tablets 318 and causes fluid-soluble tablets 318 to dissolve. As described above, fluid-soluble tablets 318 may be configured to dissolve quickly when partially or fully submerged in fluid. As fluid-soluble tablets 318 dissolve, the spring force of compression spring 312 causes piston head 308 to push against fluid-soluble tablets 318 toward lower lid 304, thereby causing piston rod 310 to pull cable 222, as denoted by the downward facing arrows adjacent to cable 222. Thus, as shown in FIG. 4C, there is less of fluid-soluble tablets 318 within chamber 301 than in FIGS. 4A and 4B, and accordingly, piston head 308 is closer to lower lid 304 than in FIGS. 4A and 4B.

Figure 4D:
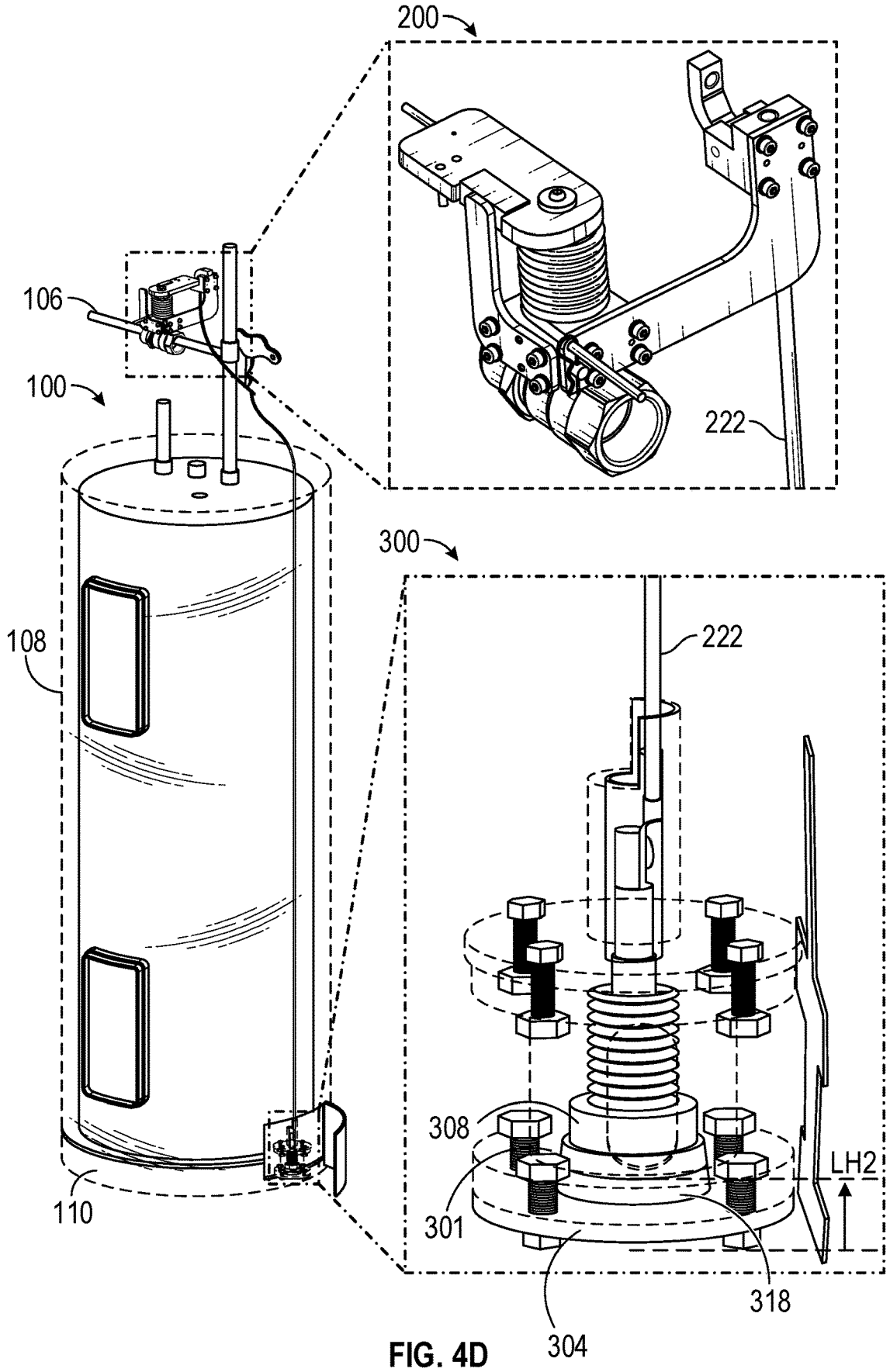

As shown in FIG. 4D, when enough of fluid-soluble tablets 318 have dissolved, such that piston rod 310 has pulled cable 222 by an amount sufficient to cause the retractable pin (not shown) to disengage with latching arm 218, handle 210 will be released from latching arm 218 and automatically transition to its closed configuration where, as shown in FIG. 2B, handle 210 rotates drive shaft 224 and actuates valve 230 via valve actuator 221 to thereby prevent fluid flow through the fluid inlet line.

Figure 5:
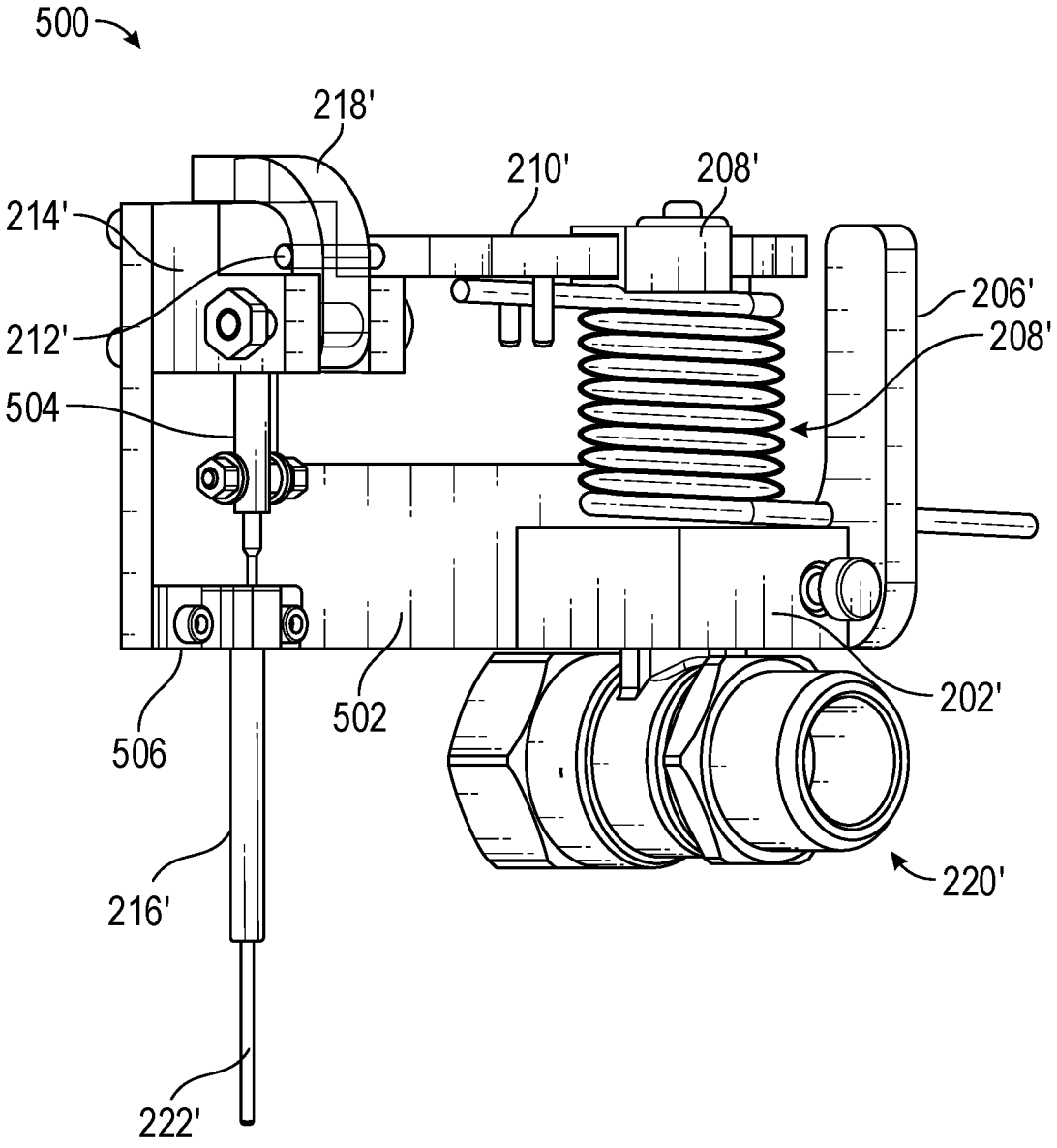
FIG. 5 illustrates an alternative automated mechanical shutoff assembly constructed in accordance with the principles of the present disclosure.

Referring now to FIG. 5, an alternative spring-loaded shutoff assembly is provided. Shutoff assembly 500 may be constructed similar to shutoff assembly 200, with similar components having like-prime reference numerals. Shutoff assembly 500 differs from shutoff assembly 200 in that shutoff assembly 500 includes first frame 502 coupled to and extending from valve attachment assembly 202' for support the latching mechanism, e.g., base portion 214' and latching arm 218'. As shown in FIG. 5, first frame 502 may have an L-shaped profile, thereby reducing size and cost for ease of manufacture of shutoff assembly 500. Moreover, shutoff assembly 500 may have retractable pin 504, which has a thinner profile than retractable pin 217, and cable mount housing 506, which also may have a smaller profile that the cable housing mount of shutoff assembly 200. As first frame 504 has a smaller profile than first frame 204, the distance between connection member 216' and retractable pin 504 may be shortened compared to shutoff assembly 200. Further, fewer components are required for cable 222' to apply a downward pulling force on retractable pin 504 than may be required for cable 222 to apply a downward pulling force on retractable pin 217.

Figure 6:
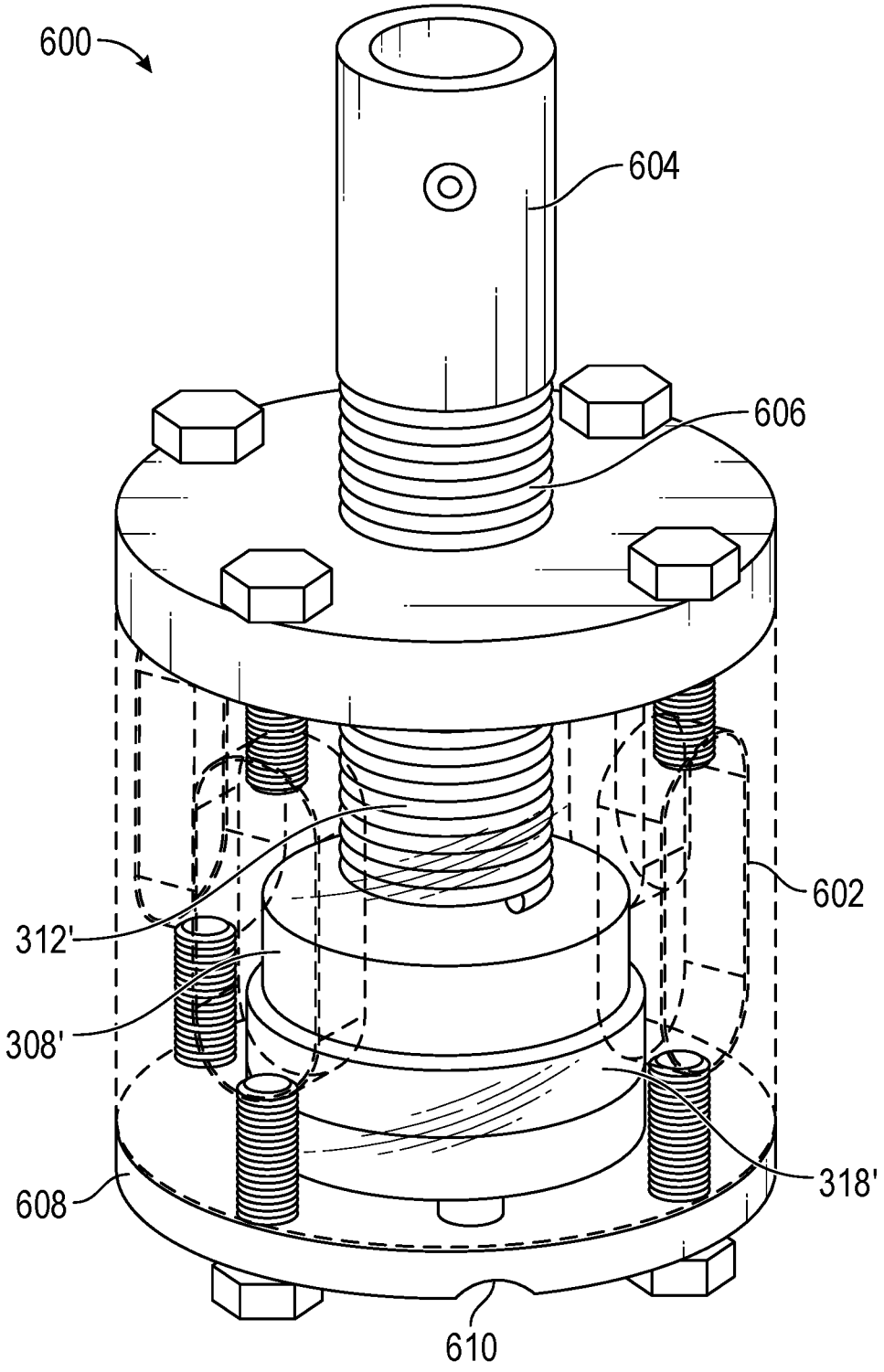
FIG. 6 illustrates an alternative leak detection assembly constructed in accordance with the principles of the present disclosure.

Referring now to FIG. 6, an alternative leak detection assembly is provided. Leak detection assembly 600 may be constructed similar to leak detection assembly 300, with similar components having like-prime reference numerals. Leak detection 600 differs from leak detection assembly 300 in that leak detection assembly 600 may include frame 602 without circumferentially extending flanges, e.g., at the upper portion coupled to upper lid 604 and at the lower portion coupled to lower lid 608. Accordingly, the flat portion of upper lid 604 and lower lid 608 may have a smaller diameter profile than the flat portion of upper lid 316 and lower lid 304, thereby reducing the overall profile of leak detection assembly 600 and reducing size and cost for ease of manufacture. As shown in FIG. 6, an exterior surface of the extended portion of upper lid 604 may have threaded surface 606, e.g., adjacent to the flat portion of upper lid 604. Moreover, lower lid 608 may include channel 610 extending from an edge of lower lid 608 toward the opening within lower lid 608 to facilitate flow of fluid across lower lid 608 and into the chamber of leak detection assembly 600.

Figure 7A:
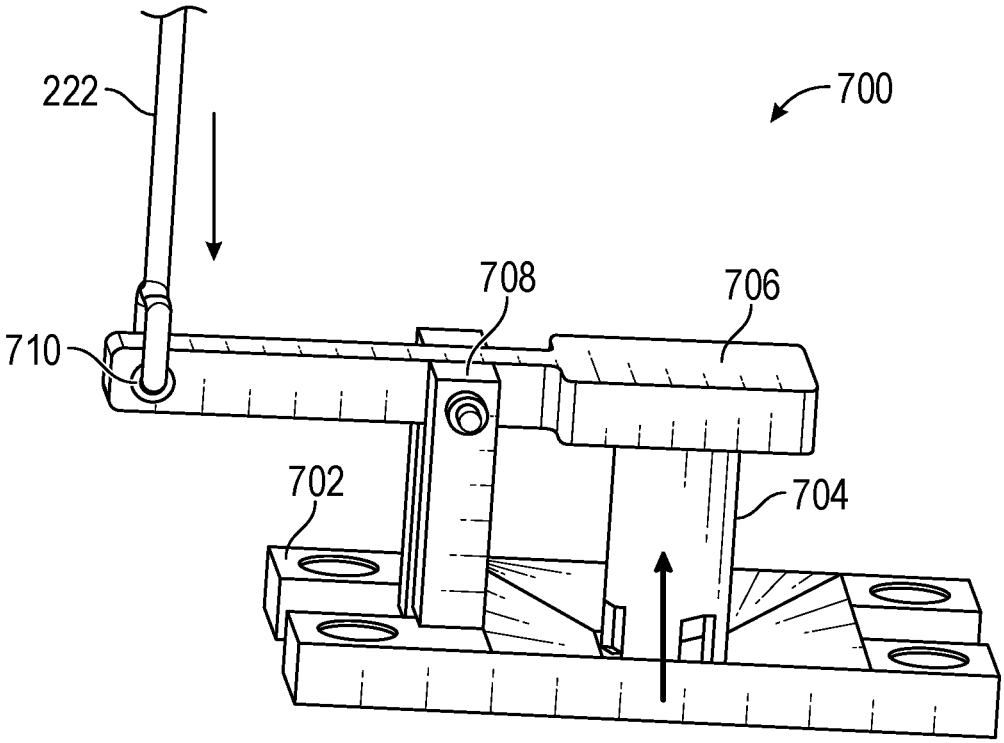
FIGS. 7A to 7C are various view of another alternative leak detection assembly constructed in accordance with the principles of the present disclosure.
Figure 7B:
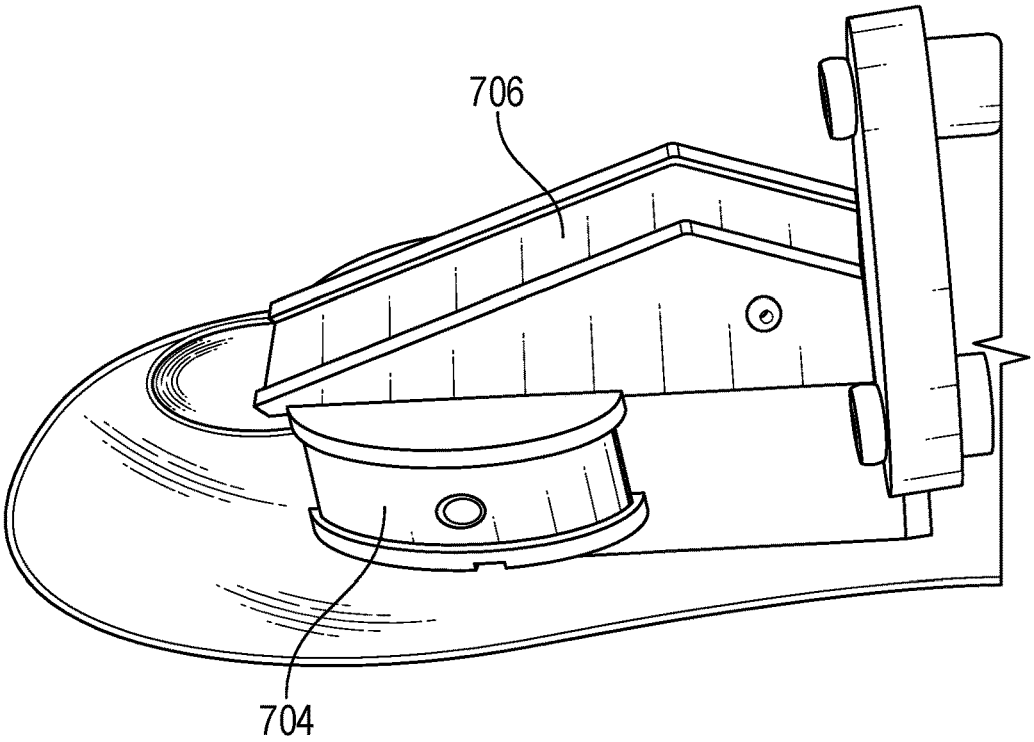
Figure 7C:
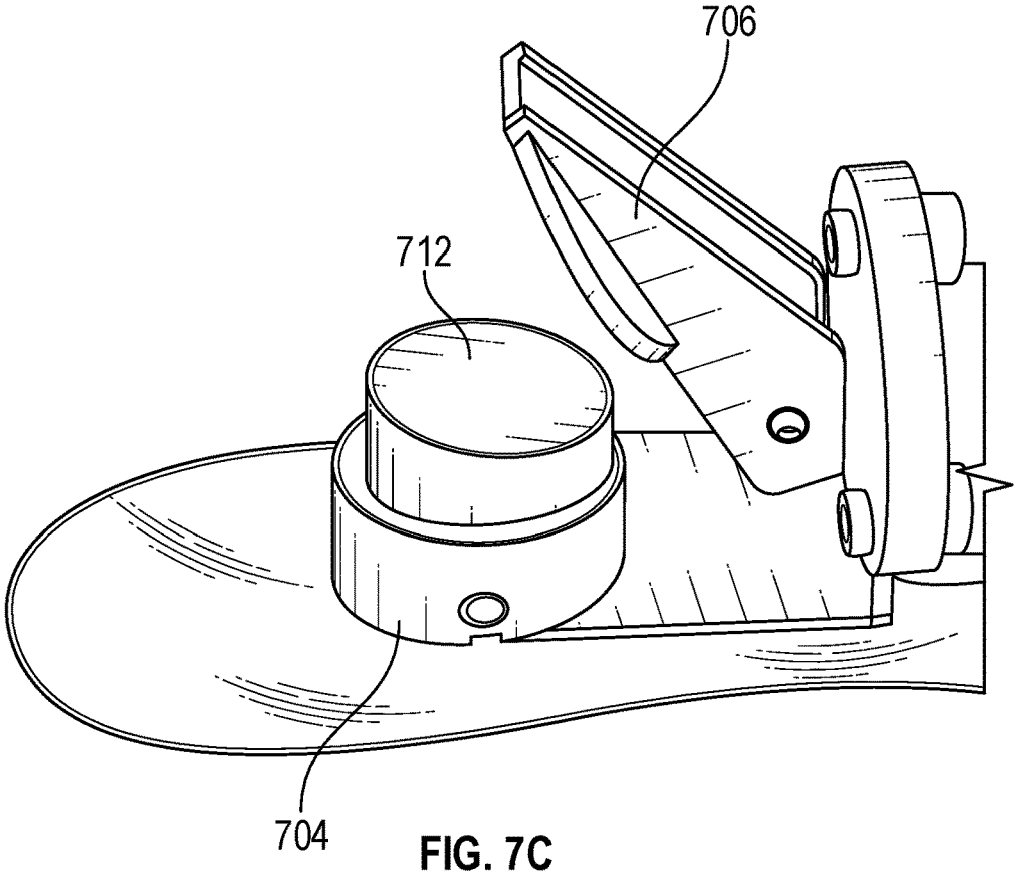

Referring now to FIGS. 7A to 7C, another leak detection assembly is provided. Leak detection assembly 700 may be operatively coupled to any one of the shutoff assemblies described herein, e.g., via cable 222, to disengage the latching mechanism and release the handle of the shutoff assembly to automatically shut off fluid flow through the fluid inlet line of the water heater upon detection of a fluid leak by leak detection assembly 700. As shown in FIG. 7A, leak detection assembly 700 may have a seesaw design including lever arm 706 pivotally coupled to base 702 at pivot point 708, and pivotally coupled to cable 222 at connection 710. Base 702 includes chamber 704 sized and shaped to receive an expandable material therein, e.g., a compressed cotton material configured to expand upon exposure to fluid via absorption of the fluid. As shown in FIGS. 7B and 7C, lever 706 may initially be in contact with the upper edge of chamber 704, such that upon exposure to fluid, e.g., water, compressed cotton 712 absorbs the fluid and expands, thereby causing lever 706 to be displaced from chamber 704. As compressed cotton 712 pushes against lever 706 with a force as denoted by the upward facing arrow in FIG. 7A, the seesaw design of lever 706 applies a downward pulling force to cable 222 as denoted by the downward facing arrow of FIG. 7A, via connection 710.

Modifications and variations of the methods and devices described herein will be obvious to those skilled in the art from the foregoing detailed description. Such modifications and variations are intended to come within the scope of the appended claims.

We claim:

1. A mechanical shutoff system for use with a water heater having a fluid inlet line, the system comprising:

a spring-loaded shutoff assembly operatively coupled to the fluid inlet line, the spring-loaded shutoff assembly comprising:

a handle configured to transition between an open configuration where fluid flow is permitted through the fluid inlet line and a closed configuration where fluid flow is not permitted through the fluid inlet line;

a torsion spring operatively coupled to the handle and configured to bias the handle toward the closed configuration; and a latch configured to transition between a locked configuration where the latch maintains the handle in the open configuration and an unlocked configuration where the torsion spring causes the handle to transition to the closed configuration, wherein the latch comprises:

a base portion fixedly coupled to a frame assembly;

a latching arm pivotally coupled to the base portion, the latching arm configured to pivotally transition between the locked configuration where the latch maintains the handle in the open configuration and the unlocked configuration; and a retractable pin configured to transition between a locked state where the retractable pin maintains the latching arm in the locked configuration and an unlocked state wherein the retractable pin disengages with the latching arm to permit the latching arm to transition from the locked configuration to the unlocked configuration; and a leak detection assembly comprising:

a chamber configured to receive a fluid-soluble material, the chamber comprising a lower lid having an opening for receiving fluid into the chamber;

a piston operatively coupled to the latch of the spring-loaded shutoff assembly via a cable extending therebetween, the piston configured to transition between a first position and a second position where the cable causes the latch to transition from the locked configuration to the unlocked configuration; and a compression spring operatively coupled to the piston and configured to bias the piston toward the second position, wherein the fluid-soluble material is positionable between the piston in the first position and the lower lid, such that as fluid enters the chamber via the opening, the fluid-soluble material dissolves and the compression spring causes the piston to transition from the first position to the second position to thereby cause the handle of the spring-loaded shutoff assembly to transition from the open configuration to the closed configuration to shut off fluid flow through the fluid inlet line.

2. The system of claim 1, wherein the spring-loaded shutoff assembly comprises a valve assembly pivotally coupled to the handle, the valve assembly configured to be attached to a valve in fluid communication with the fluid inlet line.

3. The system of claim 2, wherein the valve comprises a ball valve.

4. The system of claim 2, wherein the valve assembly comprises a rotatable drive shaft having first end fixedly coupled to the handle and a second end operatively coupled to the valve, such that as the handle transitions from the open configuration to the closed configuration, the second end of the drive shaft actuates the valve to shut off fluid flow through the fluid inlet line.

5. The system of claim 2, wherein the spring-loaded shutoff assembly comprises the frame assembly coupled to the valve assembly, the frame assembly configured to support the torsion spring and the latch.

6. The system of claim 5, wherein a first end of the torsion spring is fixedly coupled to the frame assembly, and a second end of the torsion spring is fixedly coupled to the handle, and wherein, when the handle is in the closed configuration, the torsion spring comprises a spring force sufficient to actuate the valve to shut off fluid flow through the fluid inlet line.

7. The system of claim 5, wherein the handle comprises an impact zone configured to contact the frame assembly when the handle is in the closed configuration, the impact zone configured to dampen a force applied to the handle by the frame assembly.

8. The system of claim 5, wherein the frame assembly comprises:

a first frame arm coupled to a first face of the valve assembly, the first frame arm fixedly coupled to a first end of the torsion spring; and a second frame arm coupled to a second face of the valve assembly, the second frame arm operatively coupled to the latch.

9. The system of claim 8, wherein at least one of the first or second frame arms comprises an L-shape.

10. The system of claim 1, wherein the cable is operatively coupled to the latch via the retractable pin.

11. The system of claim 10, wherein, when the piston is in the first position, the compression spring comprises a spring force sufficient to transition the retractable pin from the locked state to the unlocked state.

12. The system of claim 1, wherein the retractable pin is biased toward the locked state.

13. The system of claim 1, wherein the handle comprises an extension rod configured to extend from the handle toward the latch, and wherein, in the locked configuration, the latch secures the extension rod therein to maintain the handle in the open configuration.

14. The system of claim 1, wherein the piston comprises:

a piston rod having a first end operatively coupled to the cable, and a second end; and a piston head coupled to the second end of the piston rod, the piston head configured to contact the fluid-soluble material, wherein the compression spring is disposed between an upper surface of the chamber and the piston head.

15. The system of claim 1, wherein the lower lid is configured to be disposed a predefined distance from a ground, such that fluid leaking from the water heater must accumulate over at least the predefined distance to reach the opening of the lower lid.

16. The system of claim 1, wherein the leak detection assembly comprises one or more vents configured to permit byproducts of dissolution of the fluid-soluble material to escape therethrough.

17. A mechanical shutoff system for use with a water heater having a fluid inlet line, the system comprising:

a valve assembly configured to be attached to a valve in fluid communication with the fluid inlet line;

a handle pivotally coupled to the valve assembly and configured to transition between an open configuration where the valve permits fluid flow through the fluid inlet line and a closed configuration where valve does not permit fluid flow through the fluid inlet line;

a torsion spring operatively coupled to the handle and configured to bias the handle toward the closed configuration;

a latch configured to transition between a locked configuration where the latch maintains the handle in the open configuration and an unlocked configuration where the torsion spring causes the handle to transition to the closed configuration, wherein the latch comprises:

a base portion fixedly coupled to a frame assembly;

a latching arm pivotally coupled to the base portion, the latching arm configured to pivotally transition between the locked configuration where the latch maintains the handle in the open configuration and the unlocked configuration; and a retractable pin configured to transition between a locked state where the retractable pin maintains the latching arm in the locked configuration and an unlocked state wherein the retractable pin disengages with the latching arm to permit the latching arm to transition from the locked configuration to the unlocked configuration; and a cable having a first end operatively coupled to the latch and a second end operatively coupled to a leak detection assembly configured to pull the cable upon detection of a leak of the water heater to cause the latch to transition from the locked configuration to the unlocked configuration to thereby cause the handle of the spring-loaded shutoff assembly to transition from the open configuration to the closed configuration to shut off fluid flow through the fluid inlet line.

* * * * *